United States Patent [19]

Bialy

[11] Patent Number: 4,930,242

[45] Date of Patent: Jun. 5, 1990

[54] VERSATILE GRENADE LAUNCHER

[75] Inventor: Jacob Bialy, Tel Aviv, Israel

[73] Assignee: ISPRA-Israel Product Research Co. Ltd., Herzlia, Israel

[21] Appl. No.: 241,616

[22] Filed: Sep. 8, 1988

[30] Foreign Application Priority Data

Sep. 15, 1987 [IL] Israel ..... 83906

[51] Int. Cl.[5] ..... F41C 27/06

[52] U.S. Cl. ..... 42/105

[58] Field of Search ..... 42/105; 102/483

[56] References Cited

U.S. PATENT DOCUMENTS

| | | | |
|---|---|---|---|
| 1,374,854 | 4/1921 | Johnson | 42/105 |
| 3,534,492 | 10/1970 | Amster | 42/105 |
| 3,728,809 | 4/1973 | Mulich et al. | 42/105 |
| 3,956,843 | 3/1976 | Litman | 42/105 |
| 3,981,093 | 9/1976 | Reed | 42/105 |

FOREIGN PATENT DOCUMENTS

| | | | |
|---|---|---|---|
| 2412809 | 7/1979 | France | 42/105 |
| 406117 | 2/1946 | Italy | 102/483 |
| 102371 | 4/1917 | United Kingdom | 102/483 |

*Primary Examiner*—Charles T. Jordan
*Assistant Examiner*—Michael J. Carone
*Attorney, Agent, or Firm*—Charles E. Baxley

[57] ABSTRACT

A versatile multi-sized launcher comprising means for adapting its end to any conventional rifle including a hole fitted at the bottom of said launcher's body through which propellant gases can pass to cause the grenade to be propelled when the rifle is fired and said launcher being in the form of multiple diameter cylindrical sections joined together and gradually having the largest diameter section at the end opposite from said rifle adaptor means.

6 Claims, 2 Drawing Sheets

VERSATILE GRENADE LAUNCHER

Several types of grenade launchers to be mounted by usual means on standard rifles, for shooting grenades, and especially tear gas grenades are known in the prior art.

Some specific designs for such launchers are described in Israel Patent Application No. 80828, describing launchers comprising means for mounting the launchers on firearms and retaining the grenade in mounted position on the rifle launcher until it is fired.

All the grenade launchers known to me are usually designed to handle one single sized grenade, these launchers may be able to handle different shaped grenades (cylindrical or ball) but are always limited to a one diameter sized grenade.

It is an object of this invention to provide a grenade launcher which permits use of a multiple number of grenade sizes of different diameters, thus avoiding need to dismantle and mount different sized launchers on the user's rifle, when several different sized grenades are to be fired.

This need may especially arise in the use of tear gas grenades where different sizes and or types of grenades having different tear-gas contents, and or body materials, may be required by the user. For example, if it is necessary to handle a larger number of demonstration crowds than initially anticipated.

SUMMARY OF THE INVENTION

A versatile multi-sized grenade launcher including means well known in the art for adapting the launcher end to any conventional rifle and provided with a hole fitted at the bottom of the body of said launcher through which propellant gasses can pass to cause the grenade to fly or be propelled. The launcher is in the form of cylinder sections of multiple diameter joined together and gradually having the largest diameter section facing away from the grenade rifle adaptor means.

A preferred embodiment of the grenade launcher contemplated herein is provided with a retaining means for the grenade and comprises a cover of smaller diameter than the diameter of the largest sized grenade to be fitted on the firing or exit side. As known in the art such cover is secured by a spring or alternatively each of the cylinder sections can be provided with leaf springs securing the grenade of an appropriate size to the particular sized cylinder section.

Or the retaining means may take the form of any of the other retaining means as described in Israel Patent Application No. 80828.

In an embodiment each of the launcher cylindrical sections length is designed to be slightly smaller than the length of the grenade to be used, so that the safety pin of the grenade extends slightly out of the launcher and can easily be pulled off by the user prior to firing.

The construction material of the launcher could be either metal such as steel as in most conventional launchers or of composite reinforced plastic materials having the advantage of being much lighter in weight.

In an embodiment of the launcher there is included a body having two diameter sections only, however this should not be limiting, as the invention provides for a plurality of such sections, as would be conveniently used by the user depending on the weight and length desired. As the grenade sizes will be reduced and the material of construction of the launcher to be made from light materials (composites) the user may find it practical to have a large number of cylindrical sections.

In another embodiment the launcher could be built in the form of a continuous inverted cone of variable diameter having slits along the launcher's circumference. The required diameter is set by a circumferential band provided around the upper open end of the launcher and said band can be adjusted to the required size. The launcher's body may be made of a flexible material such as metal and composite material in the form of a cone.

For a more complete understanding of the above and other features and advantages of the invention, reference should be made to the following detailed description of a preferred embodiment and to the accompanying drawings.

BRIEF DESCRIPTION OF THE DRAWINGS

In the drawings, like reference numerals denote corresponding parts throughout the several views.

GENERAL DESCRIPTION OF THE INVENTION

Figure 1:
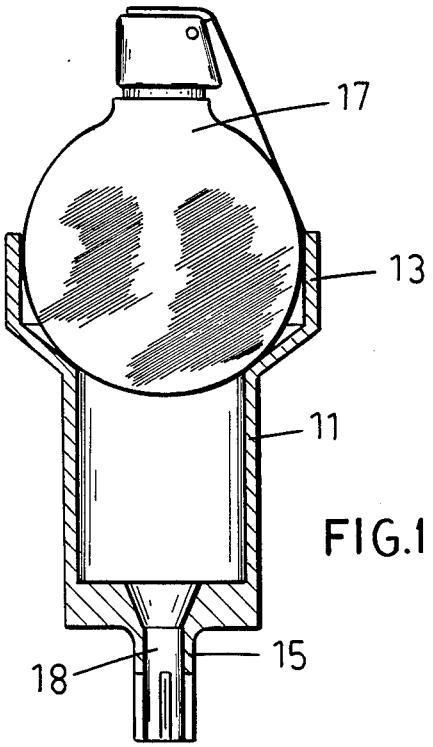
FIG. 1 is a partial sectional view of a two sized launcher where a larger sized ball grenade is used.
Figure 2:
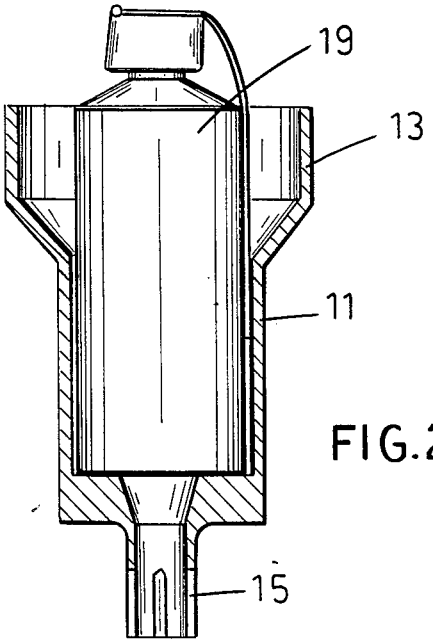
FIG. 2 is a similar view to that in FIG. 1, the same two-sized launcher is shown but with a smaller diameter cylindrical grenade.

The launcher illustrated in FIG. 1 and FIG. 2 comprises a smaller sized cylindrical body 11, connected to the larger diameter sized cylinder 13 for holding the ball grenade 17. The adaptor 15 connects the launcher to the standard rifle in any well known fashion. The propellant gasses which develop when the grenade is fired pass through hole 18 into body 11 and propel the grenade as will be understood by one skilled in the art.

In FIG. 2, a narrower cylinder grenade 19 in body 11 is shown as mounted for firing and fits into the narrow diameter section in body 11.

Figure 3:
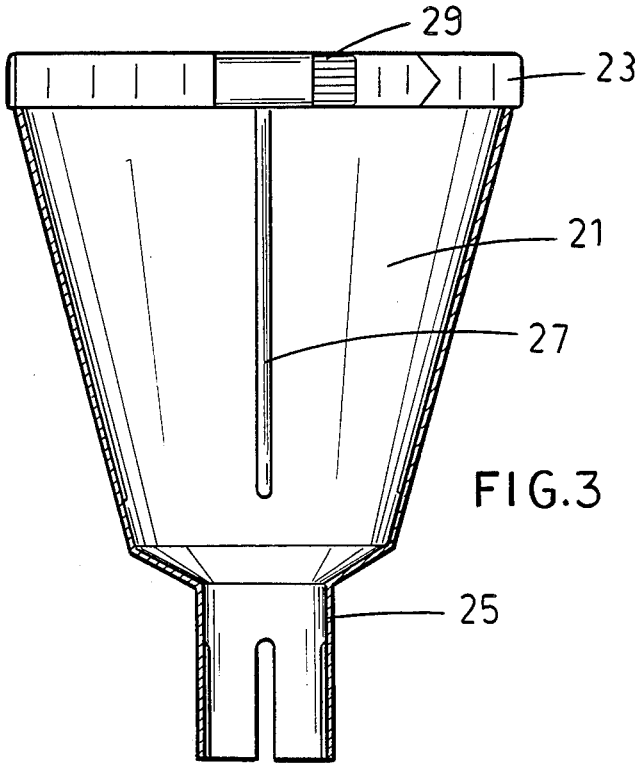
FIG. 3 shows a variable sized conical launcher.
Figure 4:
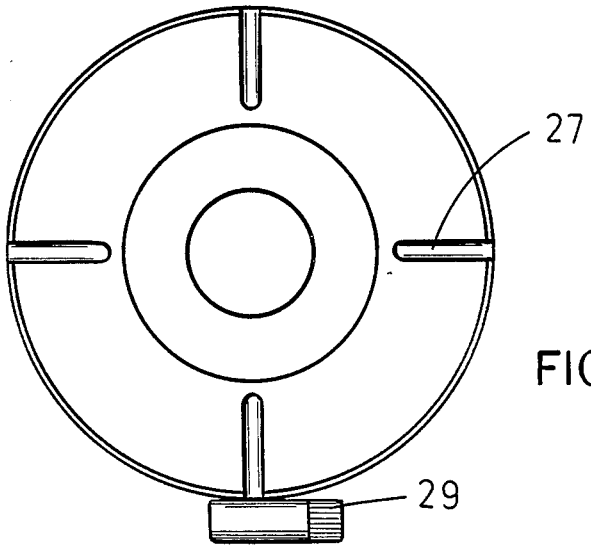
FIG. 4 is a plan view of the launcher in FIG. 3.

FIG. 3 illustrates a conical launcher 21 having a circumferential band 23 affixed to its upper open circumference. Said band 23 can be drawn or released by a screw fixture 29, thus adjusting the dimension of band 23. The flexible body of launcher 21 is adjusted to the required diameter for the different sized grenades which may be used.

The launcher's body 21 has a plurality of longitudinal slits 27 along its outer circumference enabling the launcher to adjust its inner's diameter size to the circumference of the band fixture. Band 23 being in form of an extended outer wall at the launcher covers the ends of slits 27, to avoid gas escape during firing.

It should be understood, of course, that the specific forms of the invention herein illustrated and described are intended to be representative only as certain changes may be made in the invention without departing from the clear teachings of the disclosure. Accordingly, reference should be made to the following appended claims determining the full scope of the invention.

What is claimed:

1. A grenade launcher, for use with a conventional military firearm, to accommodate a plurality of grenade sizes, the launcher comprising:

a hollow continuous barrel extension having a proximal end provided with attaching means thereon for connecting the barrel extension in sealed engagement with a barrel of the firearm to receive propellant gasses therefrom;

the barrel extension also having a distal end remote from the firearm;

the barrel extension formed into a plurality of cylindrical segments, with each of the segments larger in diameter than its next segment from the proximal end to the distal end;

at least two of the segments each sized to seat a similarly sized grenade, whereby different sizes of grenade can be hurled from the launcher;

the barrel extension defining a distal rim shorter than the grenade, so that the last mentioned grenade projects therefrom to allow removal of the grenade safety pin from the last mentioned grenade prior to firing.

2. The launcher according to claim 1 made of metal.

3. The launcher according to claim 1 made of rigid plastic material.

4. A multi-sized grenade launcher for use with a conventional military firearm, the launcher made of flexible material and comprising proximal and distal ends relative to the firearm, a tube at the proximal end insertable snugly into a barrel of the firearm, the tube diverging toward the distal end to form a frusto-conical section, the tube defining a plurality of longitudinal slits in the vicinity of the distal end, an adjustable band mountable around the distal end to converge it to a desired diameter and cover the slits.

5. The launcher according to claim 4 made of metal.

6. The launcher according to claim 4 made of rigid plastic material.

* * * * *